United States Patent [19]

Kiyono et al.

[11] Patent Number: 4,759,003

[45] Date of Patent: Jul. 19, 1988

[54] ELECTRONIC ANALOG TIMEPIECE WITH VOLTAGE CHECKING FUNCTION

[75] Inventors: Yoshihiko Kiyono; Syuji Ohtawa; Hitoshi Ochiai; Hiroshi Odagiri; Yuichi Inoue, all of Tokyo, Japan

[73] Assignee: Seiko Instruments Inc., Tokyo, Japan

[21] Appl. No.: 15,170

[22] Filed: Feb. 17, 1987

[30] Foreign Application Priority Data

Feb. 28, 1986 [JP] Japan ..... 61-43234
Mar. 3, 1986 [JP] Japan ..... 61-45876

[51] Int. Cl.[4] ..... G04B 9/00; G04B 1/00
[52] U.S. Cl. ..... 368/66; 368/204
[58] Field of Search ..... 368/66, 76, 80, 203–204

[56] References Cited

U.S. PATENT DOCUMENTS 4,041,691 8/1977 Chihara et al. ..... 368/66
4,219,999 9/1980 Ichikawa et al. ..... 368/66
4,223,522 9/1980 Nomura et al. ..... 368/66
4,259,737 3/1981 Berney ..... 368/66
4,280,208 7/1981 Nomura ..... 368/66
4,316,274 2/1982 Ushikoshi ..... 368/66
4,398,832 8/1982 Maire et al. ..... 368/76
4,630,936 12/1982 Leuenberger ..... 368/68

*Primary Examiner*—Vit W. Miska
*Attorney, Agent, or Firm*—Bruce L. Adams; Van C. Wilks

[57] ABSTRACT

An electronic analog timepiece with voltage checking function, which detects the power source condition, and which informs the user of the necessity of charging operation by changing the magnitude of the power source voltage into the distance by which the hand is carried or the amount by which the hand is moved upon operation from external side.

The hand is stopped from moving for a predetermined period of time in the first time only in which the voltage checking operation is carried out.

19 Claims, 4 Drawing Sheets

ELECTRONIC ANALOG TIMEPIECE WITH VOLTAGE CHECKING FUNCTION

BACKGROUND OF THE INVENTION

1. Field of the Invention

The present invention relates to an electronic analog timepiece with voltage checking function which uses a cell, a capacitor or the like as a power source, and which indicates the power source voltage condition relying upon the change in the distance by which a hand is carried or in the amount by which the hand is moved.

2. Description of the Prior Art

In a conventional electronic analog timepiece, the remaining power source voltage is indicated in the form of battery life display (hereinafter referred to as BLD). Namely, when the life of battery employed in the timepiece approaches the last period, the distance for carrying the second hand is varied automatically to inform the user of the necessity for renewing the cell. According to this system, however, the user cannot be informed of the necessity for renewing the cell until the hands of the timepiece are just about to be stopped, and finds it very inconvenient to use. This becomes a serious problem in the timepiece of the charging type which is a so-called semipermanent timepiece employing a secondary cell or a capacitor instead of the primary cell, and which is drawing attention in recent years.

In the conventional BLD display as mentioned above, the user is not informed of the remaining life of the cell unless the last period of the life is approached. As soon as the indication is made therefore, the user is forced to renew the cell immediately with cumbersome operation. This becomes a serious problem in the above mentioned timepiece of the charging type. This is because the timepiece of this type must employ a secondary cell or a capacitor having charging function. The power source component of this type, however, has a capacity that is very smaller than that of the primary cells. Therefore, the time (hereinafter referred to as duration) is very short in which the timepiece is driven from the fully charged condition to the BLD condition. The BLD operation that may take place at any time at a high frequency forms a factor of great inconvenience for the user who is forced to perform the charging operation. For instance, during the office hours, during the bedtime, or under the condition where the user is not allowed to perform the charging operation readily, the user feels uneasy if he thinks his timepiece is going to cease its function at any time soon. Moreover, once the hands are stopped, the user must carry out cumbersome operation for adjusting the time after the cell has been charged. This happens at a very high frequency when use is made of a secondary cell or a capacitor having capacity very smaller than that of the primary cells.

SUMMARY OF THE INVENTION

It is an object of the present invention to provide an electronic analog timepiece having charging function, which is provided with function to detect the power source voltage, and wherein a signal generated thereby is transformed into the motion of the hand upon the operation by the user to indicate the remaining amount of the power source voltage.

Another object of the present invention is to provide an electronic analog timepiece having voltage checking function which is so constructed that the hand is interrupted from being driven for a predetermined period of time at the beginning of the voltage checking operation.

The user is now liberated from the uncertainty that the BLD operation may suddenly develop and the timepiece may cease to operate under the circumstances where he is not allowed to immediately perform the charging operation such as during the office hours or during the bedtime. Namely, when the power source voltage has dropped to some extent, the user may perform the charging operation at any convenient time so that the duration can be maintained sufficiently at all times. This precludes the cumbersome operation for adjusting the time every after the hands of the timepiece have stopped moving.

Moreover when the voltage checking operation is effected, the hand stops at a position of starting the operation for a predetermined period of time, making it possible to correctly read the amount by which the hand is moved by quick-feed pulses. Furthermore, the time can be adjusted without involving the voltage checking operation that is usually performed at the first step of the crown (though only for a brief period of time) in the course when the crown is to be pulled by two steps. Namely, it is easy to stop the second hand at any position.

DETAILED DESCRIPTION OF THE PREFERRED EMBODIMENT

An embodiment of the invention will now be described in detail in conjunction with the drawings.

Figure 1:
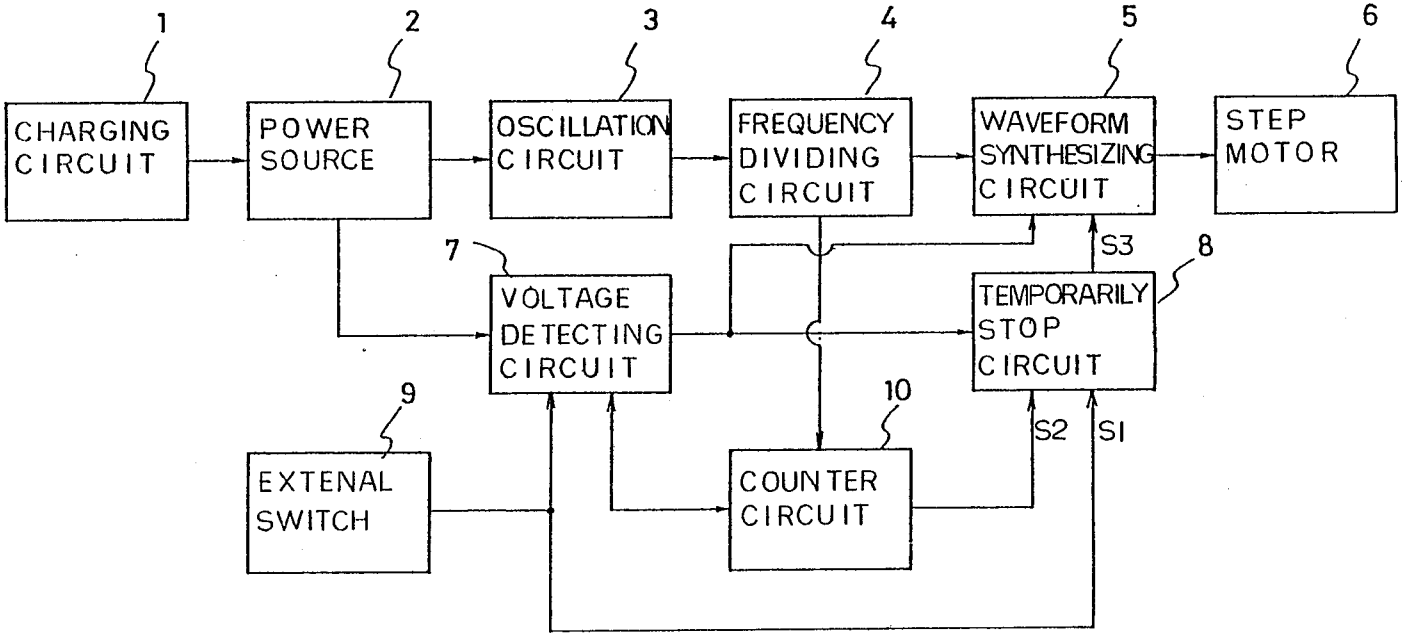
FIG. 1 is a block diagram of an electronic analog timepiece with voltage checking function according to the present invention.

FIG. 1 is a block of a timepiece according to the present invention. The timepiece comprises a charging circuit 1 which is served with light or energy from an external generator or the like, a power source 2 consisting of a secondary cell or a capacitor which receives and stores the energy from the charging circuit 1, an oscillation circuit 3 which utilizes an oscillation element such as quartz crystal and which produces outputs of a predetermined frequency, a frequency-dividing circuit 4 which frequency-divides the outputs produced from the oscillation circuit 3, a waveform synthesizing circuit 5 which forms waveforms having a variety of periods and pulse widths to drive the step motor, and a step motor 6 that serves as a torque source for driving the hand. The timepiece is driven by the above-mentioned circuits. Next, briefly described below is control means (effective to carry out voltage checking operation) which detects the power source voltage and changes the angular distance for carrying the hand or changes the amount for moving the hand depending upon the power source voltage condition.

A voltage detecting circuit 7 detects the voltage of the power source 2, and produces several kinds of detection outputs proportional to and depending upon the detected voltage. For easy explanation, in this embodiment, the hand is a second hand, and the available voltage range is from 1.2 V to 3.0 V, the range of 1.2 V to 1.5 V being referred to as the BLD, the range of 1.5 V to 2.0 V being referred to as the condition A, the range of 2.0 V to 2.5 V being referred to as the condition B, and the range of 2.5 V to 3.0 V being referred to as the condition C. The amounts for moving the second hand under these conditions are as follows: the condition A—10 seconds, the condition B—20 seconds, the condition C—30 seconds. This will be explained with reference to FIG. 2

Figure 2:
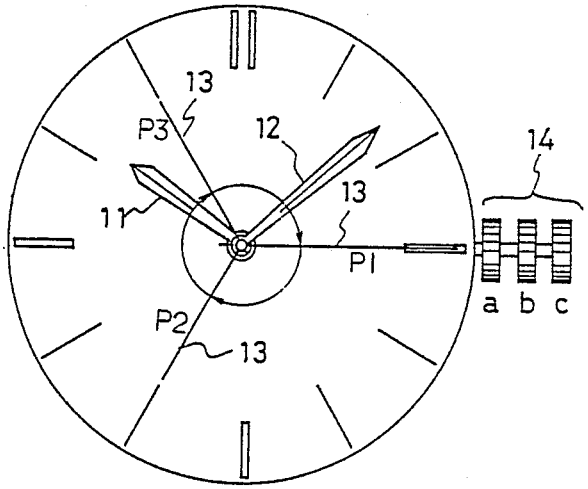
FIG. 2 is a plan view of the electronic analog timepiece with voltage checking function according to the present invention.

In FIG. 2, reference numeral 11 denotes an hour hand, 12 denotes a minute hand, 13 denotes a second hand, and 14 denotes a crown. With reference to the crown, symbol "a" denotes an ordinary or normal position, "b" denotes a first or command position, and "c" denotes a second position. Usually, the day of the week and the date are adjusted in the first position. FIG. 2 omits a small window which indicates the day of the week and the date.

It is now presumed that the crown 14 is located at the ordinary position "a", and the second hand 13 which is normally carried every second has arrived at a desired position P1 (position of three o'clock). At this time, the crown 14 is pulled to a first position "b" to check the voltage. If the power source voltage is under the condition B, the second hand 13 is moved to a destined position P2 (position of seven o'clock) by the quick-feed pulses of a frequency of, for example, 32 Hz. The second hand 13 remains at the position P2 until a time of 20 seconds passes, and is then moved to a normal position P3 (position of eleven o'clock) by the quick feed pulses. Thus, the hand is quickly carried the angular distance corresponding to the 20-second normal movement amount to indicate that the power source voltage is under the condition B, i.e., the power source voltage is within the range of from 2.0 V to 2.5 V. The similar operation is also carried out under the conditions A and C. The foregoing is described to outline the voltage checking operation.

Reverting to FIG. 1, additional operation (hereinafter referred to as temporarily stopping operation) will be described for stopping the movement of the second hand for a predetermined period of time.

If only the voltage checking operation is carried out as described above, the timepiece which consists of the charging circuit 1 through the step motor 6 described earlier needs additionally a voltage detecting circuit 7 to detect the voltage condition of the power source 2, an external or command switch 9 to initiate the voltage checking operation by the external operation member such as the crown, and a counter circuit 10 which counts the time while the second hand is under the standby condition. In order to temporarily stop the normal operation of the second hand only at the beginning of the voltage checking operation, it is necessary to newly provide a temporarily stopping circuit 8. Operation of the temporarily stopping circuit 8 will now be described.

Figure 3:
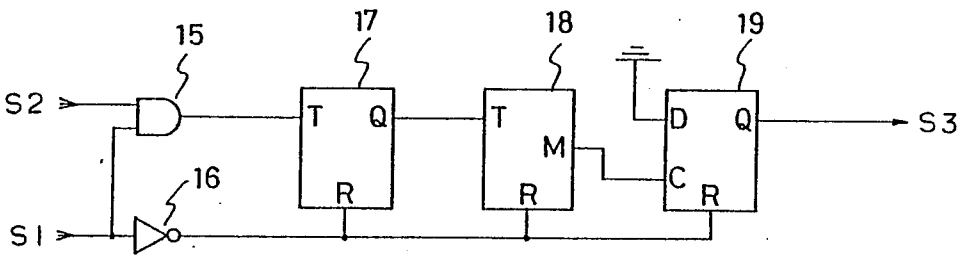
FIG. 3 is a logic diagram of a temporarily stopping circuit according to the present invention.
Figure 4:
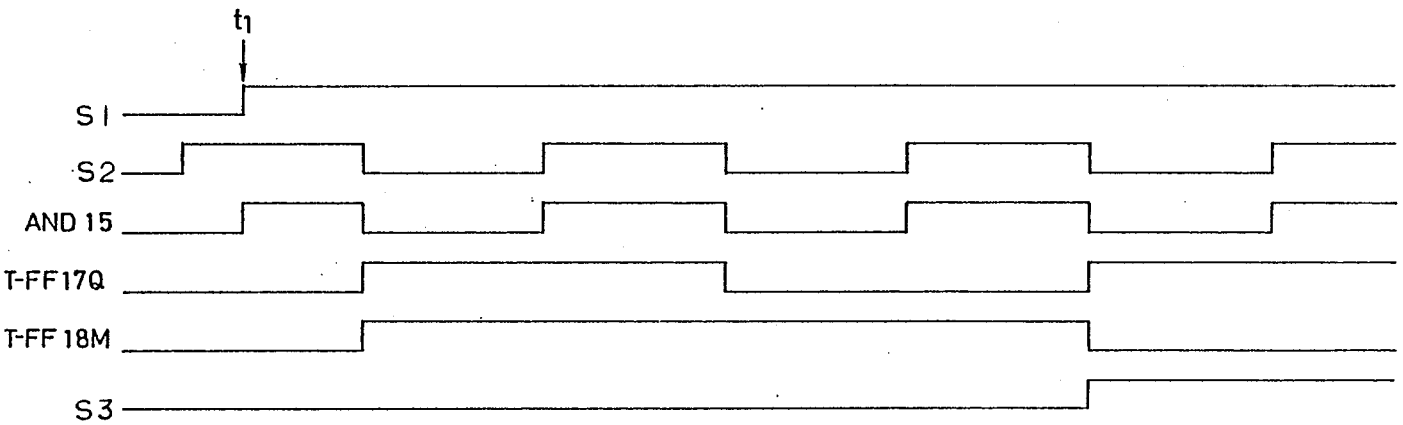
FIG. 4 is a timing chart of the temporarily stopping circuit according to the present invention.

FIG. 3 is a logic diagram illustrating an embodiment of the temporarily stopping circuit 8, and FIG. 4 is a time chart of the logic diagram of FIG. 3. An input signal S1 is sent from the external switch 9, which assumes the low level (hereinafter referred to as "L") when the second hand 13 is normally carried and which assumes the high level (hereinafter referred to as "H") during the voltage checking operation. In this embodiment, the second hand 13 is inhibited from being driven for two to three seconds at the initiation of the voltage checking operation, and an input signal S2 consists of a signal of 1 Hz. The signal of 1 Hz is applied from an AND gate (hereinafter referred to as AND) 15 to an input terminal T of a T-type flip-flop 17 (hereinafter referred to as T-FF) which is rendered operative by the input S1. In this case, however, it is not predictable when the input S1, that permits the introduction of input S2, will assume "H". Therefore, referring to FIG. 4, for instance, the output of the AND 15 is produced as shown in FIG. 4 when the input S1 is changed at $t_1$, i.e., when the input S1 is changed at a moment when the input S2 of 1 Hz assumes "H". Here, if it is presumed that T-FFs are all in the negative edge operation, the output Q of the T-FF 17 changes at the negative edge of the output of the AND 15. The same also holds true for the T-FF 18 of the next stage. However, since the master output (hereinafter referred to as output M) is used, the waveform becomes as represented by T-FF 18M in FIG. 4. FF 19 denotes a D-type flip-flop (hereinafter referred to as D-FF). Since the data terminal D is connected to the level $V_{DD}$, the output S3 assumes "H" at a moment when the output M of T-FF 18 is turned to "L". Namely, since the output S3 assumes "H" at a moment when the negative edge of the input S2 is inputted three times after the input S1 has assumed "H", the circuit composed of T-FF 17, 18 and D-FF 19 exhibits the operation of two to three seconds counter. Thus, there is constituted a temporarily stopping circuit 8 for providing a drive inhibition time of two or three seconds.

According to the electronic analog timepiece of the charging type of the present invention as described above, the power source voltage condition is indicated in the form of an amount by which the second hand is moved from a given position by the quick-feed pulses. Therefore, the electronic analog timepiece of the invention exhibits advantages as described below when compared with the conventional electronic analog timepieces that have the BLD function only.

Namely, the power source voltage condition can be confirmed by the user at any time in demand by the user. Therefore, the charging operation can be performed at any moment when the remaining amount of energy becomes small well before the life of the cell approaches the last period. Therefore, the BLD operation can be completely prevented from occurring in the circumstances where it is not allowed to readily perform the charging operation (such as during the office hours or during the bedtime). Therefore, it is easy to avoid the worst case where the hands cease to move, and it is made possible to provide a timepiece which features very high reliability without requiring adjustment of the time.

Moreover the hand is inhibited from being moved for a predetermined period of time by the output from the temporarily stopping circuit only at the beginning of the voltage checking operation, thereby eliminating problems that the position of hand is ambiguous at the time when the operation is started, or the amount by which the hand is moved is ambiguous, or it is very difficult to stop the second hand at the position of twelve o'clock in adjusting the time. Namely, in the former case, the power source voltage condition can be recognized at a glance. In the latter case, the second hand can be easily stopped at any position desired by a user in adjusting the time.

Furthermore the indicator required for the voltage checking operation is also used as the second hand, contributing greatly to simplifying the structure without using new additional parts and to markedly decreasing the manufacturing cost.

What is claimed is:

1. In an electronic analog timepiece with voltage checking function including a power source, time indicating hands and a step motor for driving the time indicating hands, the improvement comprising:

an oscillation circuit employing a quartz oscillator as a source of oscillation for generating a relatively high frequency standard signal;

a frequency dividing circuit for dividing said relatively high frequency standard signal into low frequency signals and providing a time keeping signal;

a voltage detecting circuit for detecting a voltage level of said power source and selecting an output signal from a predetermined number of output signals in response to said detected voltage level of said power source;

a waveform synthesizing circuit responsive to said time keeping signal and low frequency signals for generating a driving pulse for said step motor operative in any one of a plurality of modulated advancement modes or normal advancement mode in response to said output signal selected by said voltage detecting circuit;

a counter circuit responsive to said time keeping signal and said output signal selected by said voltage detecting circuit for counting the number of pulses of said time keeping signal inputted during a voltage indicating operation and memorizing said number of pulses in proportion to a distance or an amount by which at least one of said hands used as a voltage indicator is driven corresponding to said output signal selected by said voltage detecting circuit; and an external operation member for starting a voltage checking operation of said voltage detecting circuit in response to a manual operation.

2. An electronic analog timepiece as claimed in claim 1; wherein said hand used as the voltage indicator comprises a second hand.

3. An electronic analog timepiece as claimed in claim 1; wherein said external operation member comprises a crown.

4. An electronic analog timepiece as claimed in claim 1; including means for determining the amount of movement of said hand smaller than 360° from a given position on a dial.

5. An electronic analog timepiece as claimed in claim 3; wherein the crown includes means defining a first position at which the voltage checking operation is carried out.

6. An electronic analog timepiece as claimed in claim 1; wherein the waveform synthesizing circuit includes means for generating quick-feed driving pulses that drive said hand used as an indicator, and have a period of greater than 4 Hz but smaller than 128 Hz.

7. An electronic analog timepiece as claimed in claim 1; including means for determining the distance for carrying said hand relatively long when the power source voltage is high, and relatively short when the power source voltage is low.

8. An electronic analog timepiece as claimed in claim 1; including means for determining the amount for moving said hand relatively large when the power source voltage is high, and relatively small when the power source voltage is low.

9. An electronic analog timepiece as claimed in claim 1; further comprising:

a temporarily stopping circuit for inhibiting the output of driving pulses from said waveform synthesizing circuit for a predetermined period of time only at the beginning of the voltage checking operation.

10. An electronic analog timepiece as claimed in claim 9; wherein the temporarily stopping circuit includes means for determining said predetermined period of time longer than one second but shorter than five seconds.

11. In a timepiece having a power source for producing a varying voltage to power the timepiece and a stepping motor for normally driving a hand to indicate time: detecting means connected to the power source for detecting the varying voltage of the power source and producing a corresponding detection signal proportional to the magnitude of the detected voltage; command means manually operable for producing a command signal effective to initiate the indication of the magnitude of voltage produced by the power source; and controlling means connected to the detecting means, stepping motor and command means for controlling the stepping motor to suspend the normal driving of the hand in response to the command signal to place the hand in a desired position and thereafter to quick-feed the hand through an angular distance determined according to the detection signal from the desired position to a destined position indicative of the magnitude of voltage with respect to the desired position.

12. A timepiece according to claim 11; wherein the controlling means includes means for controlling the stepping motor to hold the hand in the desired position for a predetermined period after the suspension of the normal driving of the stepping motor.

13. A timepiece according to claim 11; wherein the controlling means includes means for controlling the stepping motor to quick-feed the hand from the destined position to a normal position indicative of the current time after the indication of the voltage magnitude to thereby recover the normal driving of the stepping motor.

14. A timepiece according to claim 13; wherein the means for controlling the stepping motor includes means for determining the amount of angular distance from the destined position to the normal position.

15. A timepiece according to claim 14; wherein the means for determining includes means for counting a time interval during the suspension of the normal driving of the stepping motor.

16. A timepiece according to claim 11; including a second hand driven to indicate the voltage magnitude.

17. A timepiece according to claim 11; wherein the command means comprises a crown manually movable between a normal position and a command position at which the crown produces the command signal.

18. A timepiece according to claim 17; wherein the power source comprises a rechargeable power source for producing a voltage diminishing in the course of discharge.

19. A timepiece according to claim 18; including means for charging the rechargeable power source when the voltage drop is indicated.

* * * * *